US006314970B1

(12) United States Patent
Everett

(10) Patent No.: US 6,314,970 B1
(45) Date of Patent: Nov. 13, 2001

(54) RECYCLING PRESSSURE CLEANING SYSTEM FOR MICRO DISPENSING TIPS

(76) Inventor: Alan L. Everett, 12928 Big Tree Rd., East Aurora, NY (US) 14052

( * ) Notice: Subject to any disclaimer, the term of this patent is extended or adjusted under 35 U.S.C. 154(b) by 0 days.

(21) Appl. No.: 09/465,482

(22) Filed: Dec. 16, 1999

Related U.S. Application Data

(60) Provisional application No. 60/112,437, filed on Dec. 16, 1998.

(51) Int. Cl.[7] ..... B08B 9/093; B08B 3/00

(52) U.S. Cl. ..... 134/22.18; 134/169 R; 134/170

(58) Field of Search ..... 134/22.18, 169 R, 134/170

(56) References Cited

U.S. PATENT DOCUMENTS 4,525,220 * 6/1985 Sasa et al. ..... 134/21

* cited by examiner

*Primary Examiner*—Frankie L. Stinson
*Assistant Examiner*—Yolanda E. Wilkins
(74) *Attorney, Agent, or Firm*—Hodgson Russ LLP

(57) ABSTRACT

A recycling, pressure cleaning system for micro dispensing tips wherein the cleaning fluid is drawn into a plunger assembly from around the submerged, micro dispensing tip, and then, under high pressure created by pressing down on the plunger, the cleaning fluid is pressurized to move rapidly through the micro dispensing tip. This pressurized fluid moving rapidly through the tip and hypo combination, forces the removal of contaminants. The procedure is repeatable. The cleaning fluid(s) remain contained within the unit. The operator and surrounding environment are protected from release of the cleaning fluid(s) and/or contaminants. The entire top section of the cleaning unit is easily removed by rotating the top section a small amount from the bottom. This allows the operator ease in access to the micro dispensing tip during attachment, removal, and inspection. In addition, removal of the contaminated waste fluid and cleaning efficiency of the cleaning apparatus is increased.

12 Claims, 17 Drawing Sheets

RECYCLING PRESSSURE CLEANING SYSTEM FOR MICRO DISPENSING TIPS

CROSS-REFERENCE TO A RELATED APPLICATION

Applicant hereby claims priority on earlier filed provisional patent application Ser. No. 60/112,437 filed Dec. 16, 1998 and entitled "Recycling Pressure Cleaning System For Micro Dispensing Tips" which is incorporated herein by reference.

BACKGROUND OF INVENTION

This invention relates to the art of tips or nozzles in apparatus for dispensing liquids such as adhesives, and more particularly to a new and improved cleaning system for such nozzles or tips.

Due to the miniaturization increase in electronic technology, various viscous and non-viscous adhesives were developed to adhere component assemblies (i.e. circuit boards, connectors, chips). Positive displacement pumps and the like were designed to apply the electronic adhesives. Some pumps interface with programmable controllers enabling accurate, multi-positioning, and rapid dispensing of the adhesives. Positioning and dispensing accuracies are vital to this electronic technology.

Micro dispensing of the electronic adhesive has been accomplished by means of disposable, hypodermic needle, dispensing tips. An example of a dispensing tip is shown in U.S. Pat. No. 4,572,103 issued Feb. 25, 1986, the disclosure of which is hereby incorporated by reference. The dispensing tips fasten to the dispensing pump using a "Leur" thread lock. These tips are very precise which translates to high costs. Currently, all dispensing tips are very difficult to clean of the electronic adhesive during and between application processes. Thus, the tips are disposed of, adding to the cost of such electronic component assembly processes.

A quick change micro dispensing tip with disposable liner for dispensing liquid such as viscous and non-viscous adhesives in electronic component assembling is shown and described in pending U.S. patent application Ser. No. 09/360,972 filed Jul. 27, 1999 entitled "Quick Change Micro Dispensing Tip With Disposable Liner," the disclosure of which is hereby incorporated by reference.

The dispensing tips described hereinabove require ultra clean, non contaminated surfaces for adhesive passage. Due to the fact that while in production a single, micro dispensing tip may be utilized for different adhesives or a single adhesive may become a source for contamination, a rapid, positive, and user friendly method and apparatus for cleaning the dispensing tip is required.

SUMMARY OF THE INVENTION

The present invention provides a recycling, pressure cleaning system for micro dispensing tips wherein the cleaning fluid is drawn into a plunger assembly from around the submerged, micro dispensing tip, and then, under high pressure created by pressing down on the plunger, the cleaning fluid is pressurized to move rapidly through the micro dispensing tip. This pressurized fluid moving rapidly through the tip and hypo combination, forces the removal of contaminants. The procedure is repeatable. The cleaning fluid(s) remain contained within the unit. The operator and surrounding environment are protected from release of the cleaning fluid(s) and/or contaminants. The entire top section of the cleaning unit is easily removed by rotating the top section a small amount from the bottom. This allows the operator ease in access to the micro dispensing tip during attachment, removal, and inspection. In addition, removal of the contaminated waste fluid and cleaning efficiency of the cleaning apparatus is increased.

The following detailed description of the invention, when read in conjunction with the accompanying drawings wherein the same reference numerals denote the same or similar parts throughout the several views, is in such full, clear, concise and exact terms as to enable any person skilled in the art to which it pertains, or with which it is mostly nearly connected, to make and use the invention.

DETAILED DESCRIPTION OF THE ILLUSTRATED EMBODIMENT

Figure 1:
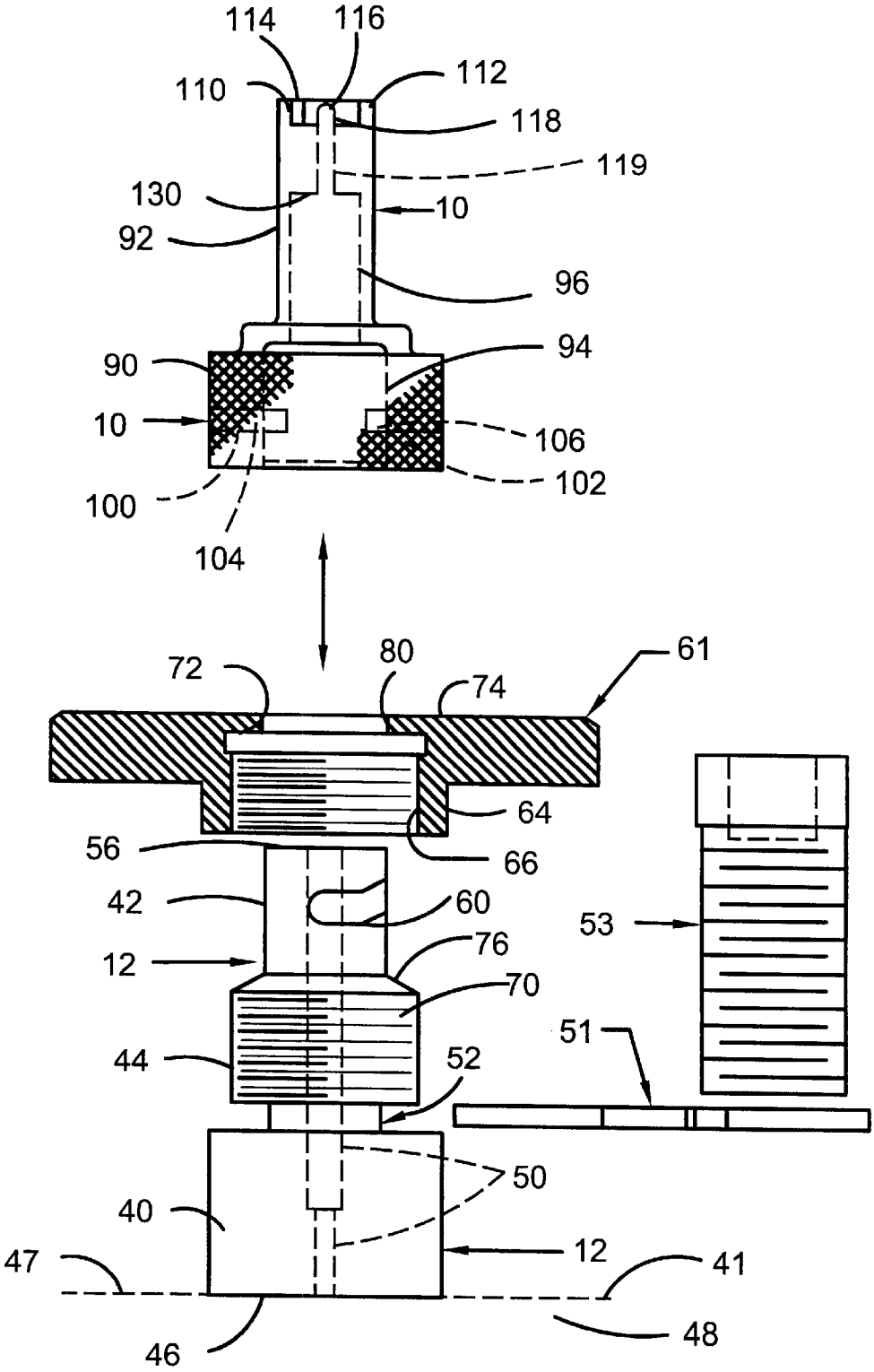
FIG. 1 is a developed elevational view illustrating a form of dispensing tip cleaned by the system of the present invention.

By way of background, an example of a dispensing tip 10 which is cleaned by the system of the present invention is illustrated in FIG. 1. Tip 10 is attached to a dispensing pump by an arrangement including adapter 12. Adapter 12 has a first cylindrical body portion 40, a second, smaller diameter cylindrical body portion 42 and a third body portion 44 of intermediate diameter axially between portions 40 and 42. Body portion 40 has a smooth, flat end surface 46 which contacts an end surface 47 of a dispensing pump housing 48. Adapter 12 has a longitudinal through bore or passage 50 which communicates with the pump outlet opening or port in surface 47. Adapter 12 in the present example is held in place by an arm 51 having one end which locks in an annular recess 52 between adapter body portions 40 and 44 and which arm 51 has an opposite end provided with an opening to receive the shank of a screw 53 which is connected in the pump housing. Other arrangements can of course be employed for securing the adapter to the pump at the location of the pump outlet.

The adapter body portion 42 terminates in a smooth, flat end surface 56. Body portion 42 is provided with a pair of grooves or tracks, one of which is designated 60 in FIG. 1, to receive pins of tip 10 in a locking relationship, much like a bayonet connecting arrangement. Other connecting arrangements can of course be employed in various forms of tips. A cap 61 is provided with an annular, boss-like extension 64 on one surface thereof, the inner surface of which is provided with threads 66 which extend further axially into the body of cap 61. The threads 66 in cap 61 engage threads 70 on the outer surface of adapter intermediate body portion 44 when cap 61 is rotated on adapter 12. This rotation of cap 61 is stopped by engagement between an inner annular seat 72 defined within cap 61 between threads 66 and the major end surface 74 of cap 10 and an annular step 76 defined between adapter body portions 42 and 44. A central opening 80 extends between the interior of extension 64 and cap surface 74 and is of a diameter to receive adapter body portion 42. The foregoing arrangement including cap 61 is of course illustrative of various arrangements which can be employed.

Dispensing tip 10 has a first cylindrical body portion 90 and a second, smaller diameter body portion 92 extending axially therefrom. Body portion 90 has an interior region 94 which meets the slightly smaller diameter interior region 96 of body portion 92. The wall of body portion 90 is provided with diametrically opposite bores 100, 102 which have a common axis extending perpendicular to the longitudinal axis of tip 14. A pair of pin-like members 104 and 106 are fixed in bores 100 and 102, respectively, and extend into the interior region 94. The pins 104, 106 are received in the tracks or slots, i.e., track 60, during an insertion and ¼ turn motion when tip 14 is connected to adapter 12. Other arrangements can of course be employed for connecting tip 10 to adapter 12.

The end of tip body portion 92 has a pair of extensions or feet 110, 112 defining therebetween a recessed end region 114 containing the tip 116 of a nozzle 118 formation, the opposite end of which is in communication with interior region 96 via a passage 119. Feet 110, 112 contact the surface to which adhesive is to be applied and space nozzle tip 116 a short distance from the surface so that the small quantity or dot of adhesive can leave nozzle tip 116 and be applied properly to the surface. In addition, nozzle tip 16 is chamfered to help form the dot of adhesive material leaving the nozzle and to facilitate removal of the dot of material from the nozzle tip. More than one nozzle and various feet configurations can be employed.

By way of example, in an illustrative dispensing tip, the opening at the end of nozzle tip 116 can range in diameter from about 0.003 inch to about 0.033 inch depending upon the nature of the material being dispensed and the desired size of the dot of material leaving nozzle tip 116. The outer diameter of nozzle 118 can range from about 0.012 inch to about 0.050 inch and nozzle 118 typically can be about 0.121 inch in length. The distance between a plane passing through the end of nozzle tip 116 and a plane coincident with the end surfaces of the feet or standoffs 110, 112 can range from about 0.003 inch to about 0.020 inch again depending upon the nature of the material being dispensed and the desired size of the dot of material leaving nozzle tip 116. The chamfer angle on nozzle tip 116 typically is about 70° measured between a plane normal to the longitudinal axis of nozzle 118 and the chamfered surface. Interior region 94 can have a diameter of about 0.164 inch, interior region 96 can have a diameter of about 0.0938 inch and tip 10 can have an overall length of about 0.537 inch.

Tip 10 is illustrative of various micro dispensing tips which can be cleaned by the system of the present invention. In this illustration, the surfaces of regions 94 and 96 and the surfaces of tip 116, nozzle 118 and passage 119 are what is desired to be cleaned. The arrangement shown in FIG. 1 is an example of various arrangements which can be employed for attaching micro dispensing tips to dispensing pumps. For a more detailed description of the foregoing, reference may be made to the above-referenced pending U.S. patent application Ser. No. 09/360,972.

The dispensing tips described hereinabove require ultra clean, non-contaminated surfaces for adhesive passage. Due to the fact that while in production a single, micro dispensing tip may be utilized for different adhesives or a single adhesive may become a source for contamination, a rapid, positive, and user friendly method and apparatus for cleaning the dispensing tip is required.

Figure 2:
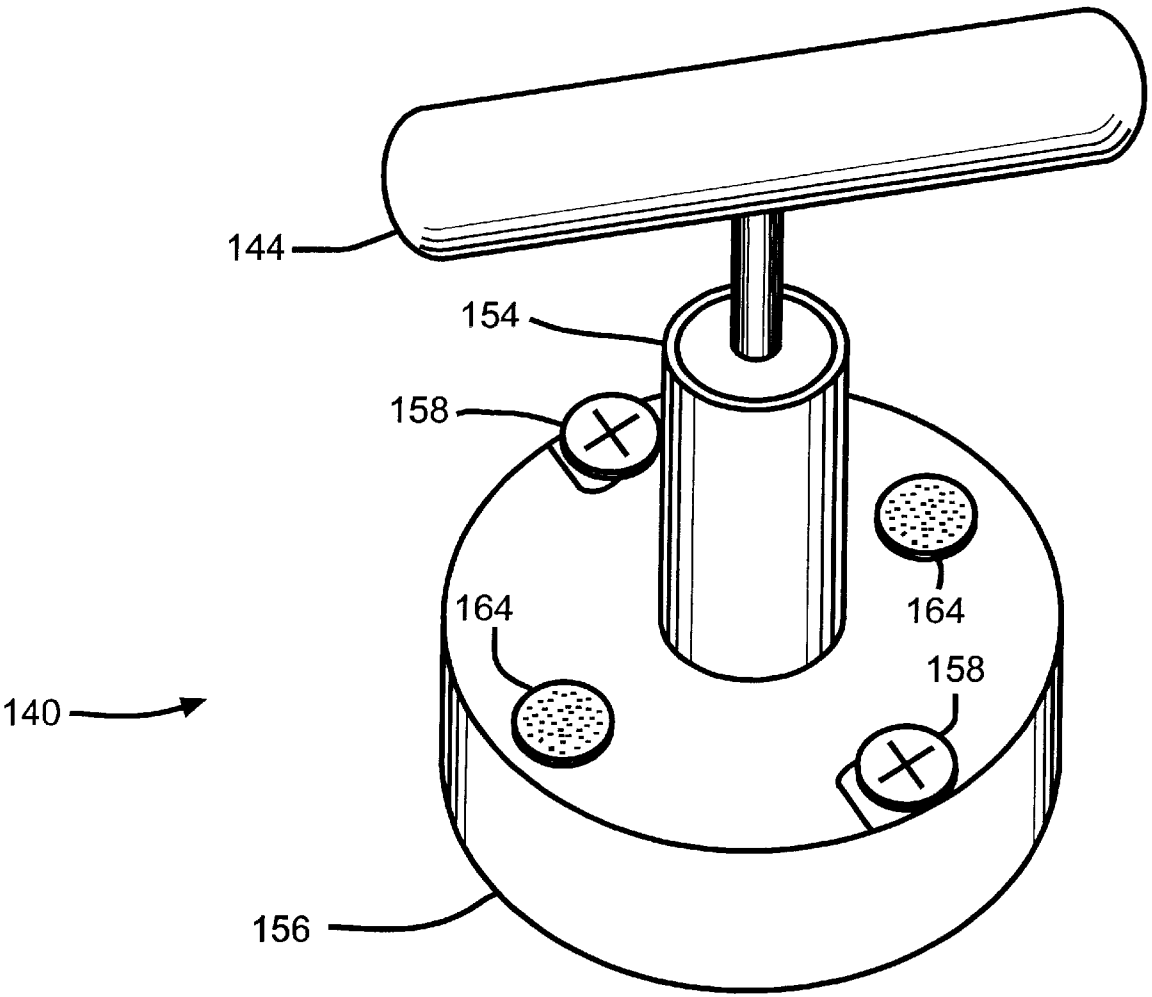
FIG. 2 is a perspective view of the recycling pressure cleaning apparatus for micro dispensing tips according to the present invention.

The recycling pressure cleaning apparatus 140 for micro dispensing tips is shown in FIGS. 2–21 of the accompanying drawing. The apparatus 140 is shown in FIG. 2 in assembled condition ready for use.

Figure 3:
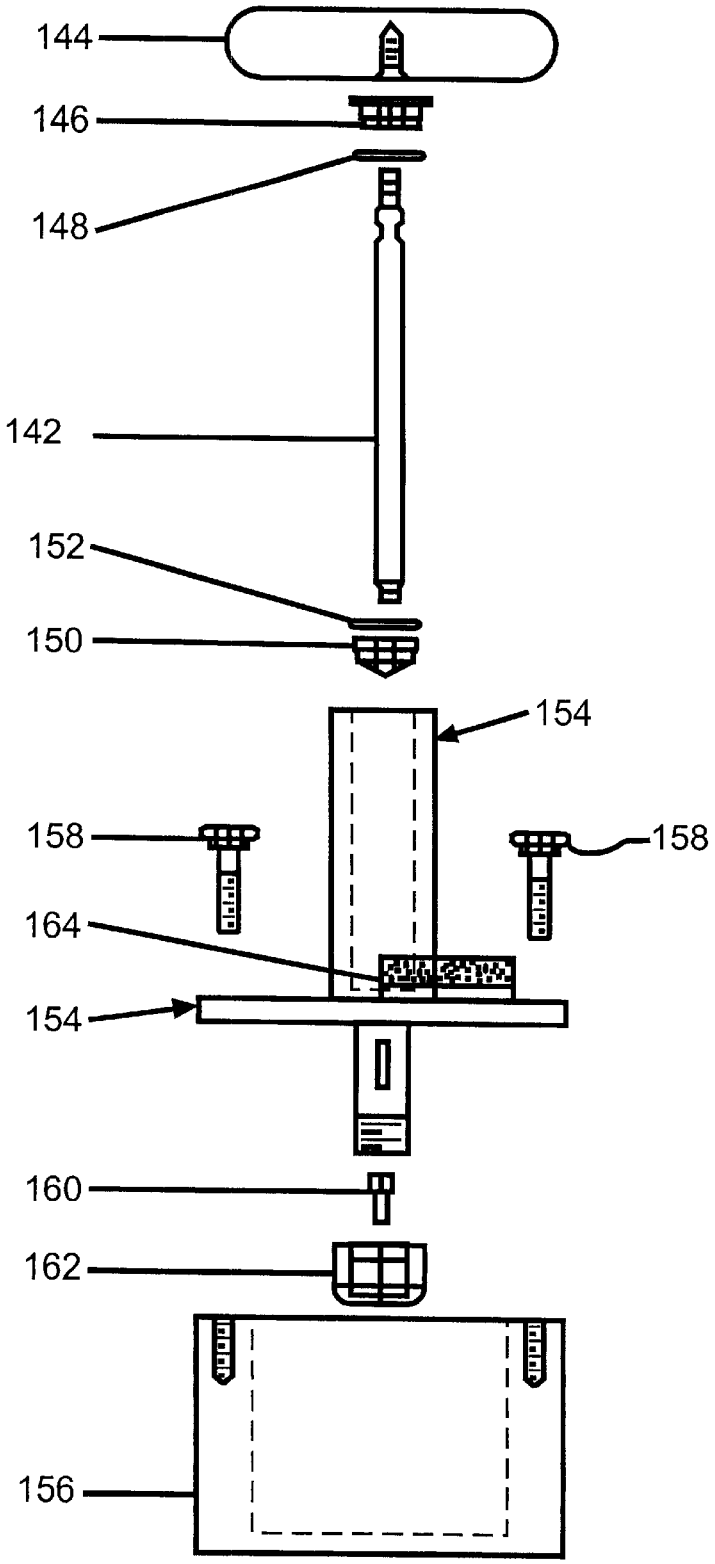
FIG. 3 is a developed elevational view further illustrating the apparatus of the present invention.

Referring to FIG. 3 a shaft 142 is connected at one end to a handle 144 through a plunger cap 146 and O-ring 148, and shaft 142 is connected at the opposite end to a plunger tip 150 through an O-ring 152. Shaft 142 and plunger tip 150 are received in a plunger cylinder assembly 154 which rests on the top of a cleaner bowl 156 and is releasably secured thereto by means of screws 158 in a manner which will be described. A tip adapter 160 and a tip retaining cap 162 are on the end of plunger cylinder assembly 154 located in bowl 156. Tip adapter 160 is similar to tip adapter 12 shown in FIG. 1. The tip to be cleaned, of the type like tip 10 shown in FIG. 1, is connected to adapter 160 and located within cap 162. A brush pad 164 is provided on the plunger assembly 154.

The recycling pressure cleaning system for micro dispensing tips according to the present invention is operated in the following manner. The cleaning fluid is drawn into the plunger assembly (components 142–154) from around the submerged, micro dispensing tip. Then, under high pressure created by pressing down on the plunger handle 144, the cleaning fluid is pressurized to move rapidly through the micro dispensing tip. This pressurized fluid moving rapidly through the tip and hypo combination, forces the removal of contaminants. The procedure is repeatable. The cleaning fluid(s) remain contained within the unit (components 154–162). The operator and surrounding environment are protected from release of the cleaning fluid(s) and/or contaminants. The entire top section of the cleaning unit (components 142–154) are easily removed by rotating the top section appropriately 1/16 turn, counterclockwise from the bottom to release formations in the periphery of plunger cylinder assembly 154 from screws 158 in a manner which will be described. This allows the operator ease in access to the micro dispensing tip during attachment, removal, and inspection. In addition, removal of the contaminated waste fluid and cleaning efficiency of the cleaning apparatus is increased.

Figure 4:
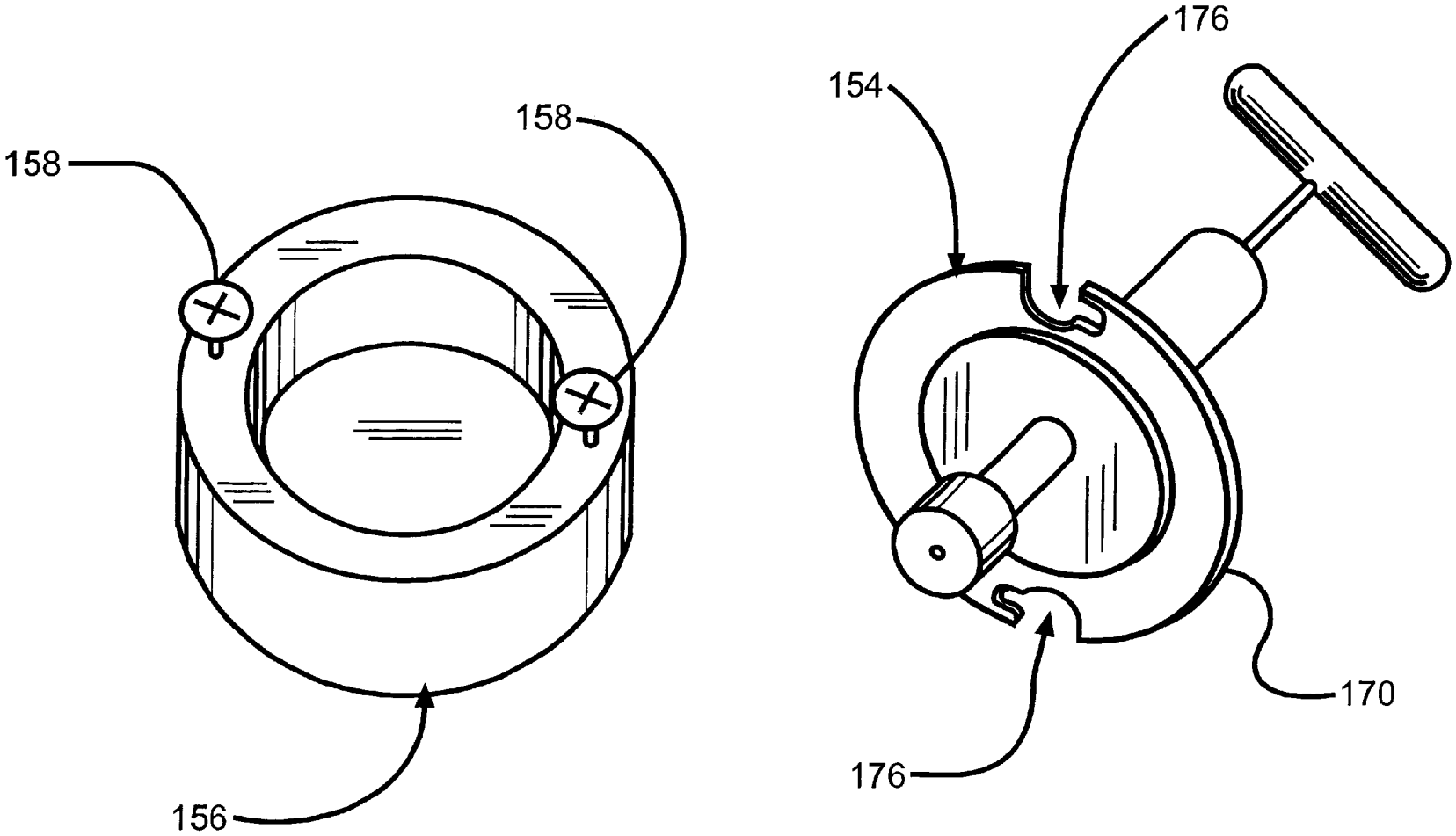
FIG. 4 is a perspective view of the apparatus of the present invention showing the plunger cylinder assembly disassembled from the container bowl.

FIG. 4 shows in further detail the plunger cylinder assembly 154 which has a disc-like body portion 170 which serves as a lid or cover to close the open top of bowl 156 when plunger cylinder assembly 154 is connected onto bowl 156 with the tip adapter 160, tip retaining cap 162 and the dispensing tip to be cleaned being located within bowl 156. Body portion 170 has diametrically oppositely located formations 174 and 176 each having a first portion shaped to receive or clear the heads of screws 158 and a second portion extending from the first portion and each shaped to receive the shank of a corresponding one of the screws 158. This arrangement provides for the ease in removal of the top section of the cleaning apparatus by the approximately 1/16 turn previously described.

Figure 5:
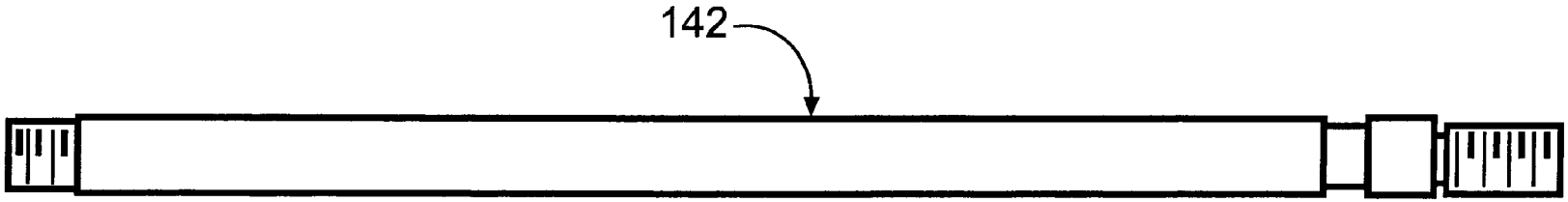
FIGS. 5, 6 and 7 are side elevational views further illustrating the plunger shaft, plunger cap and plunger tip, respectively, of the apparatus of FIG. 3.
Figure 7:
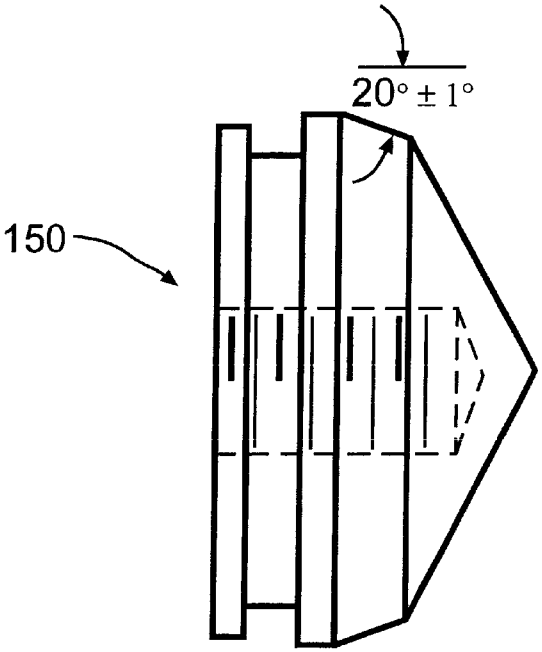
Figure 6:
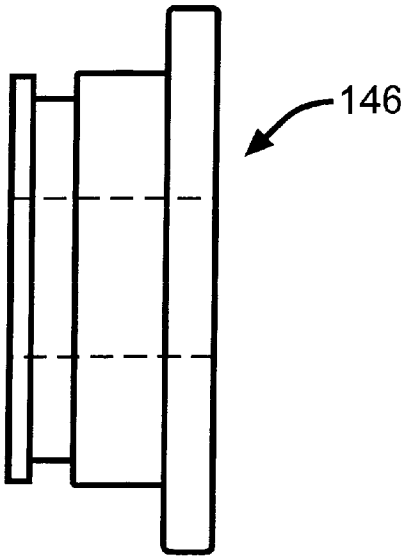
Figure 8:
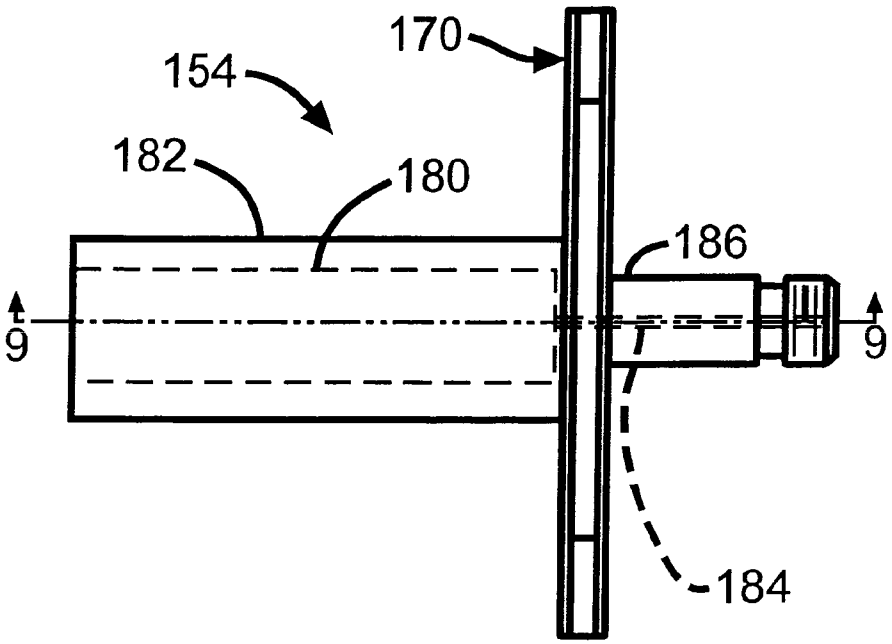
FIG. 8 is a side elevational view of the plunger cylinder assembly of the apparatus of FIG. 3.

FIGS. 5, 6 and 7 are elevational views showing in further detail the plunger shaft 142, the plunger cap 146 and the plunger tip 150, respectively.

Figure 9:
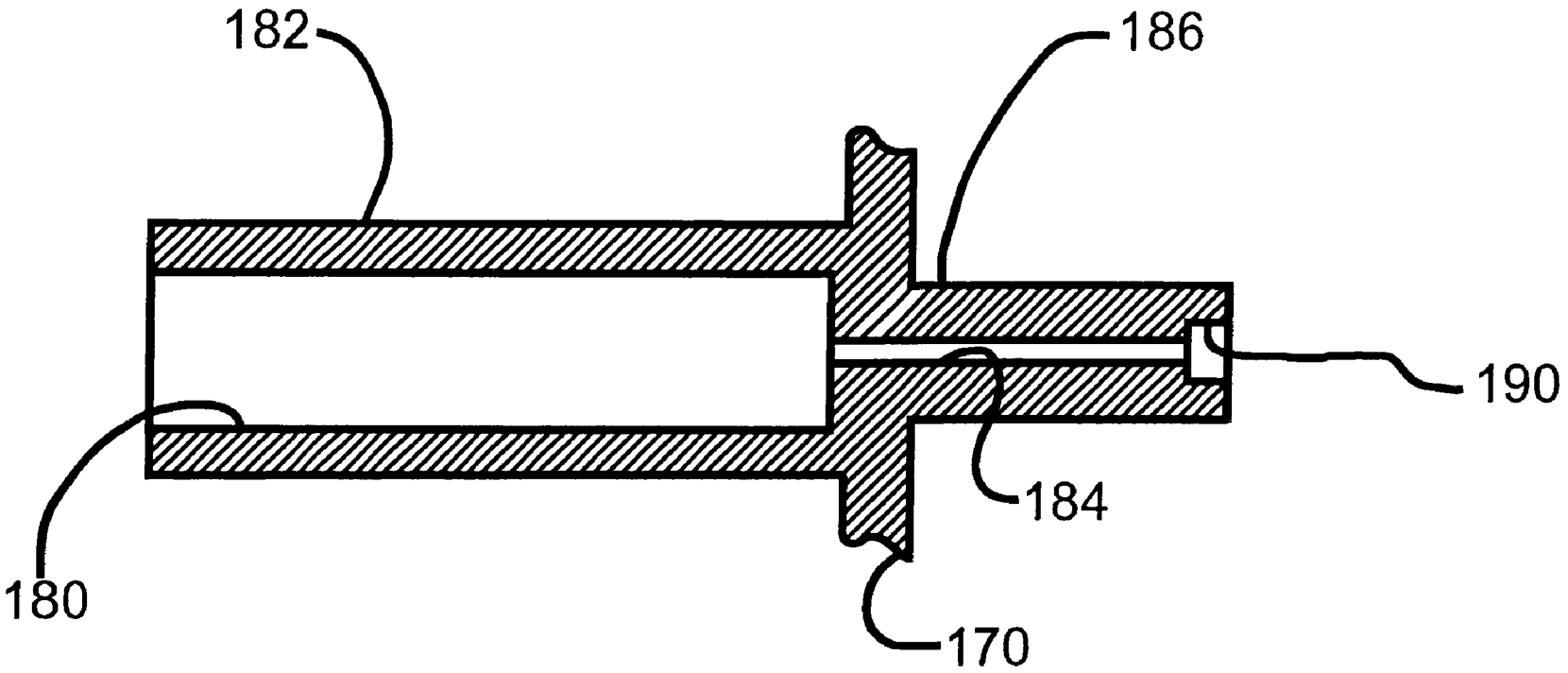
FIG. 9 is a sectional view taken about on line 9—9 in FIG. 8.

The plunger cylinder assembly 154 is shown in further detail in FIGS. 8–11. A first, relatively larger diameter passage 180 extends longitudinally along within a first body portion 182 of plunger assembly 154. Plunger tip 150 and plunger shaft 142 travel along within passage 180. A second, relatively smaller diameter passage 184 extends longitudinally along within a second body portion 186 of plunger assembly 154. By way of illustration of the relative cross-sectional sizes of passages 180 and 184, in an illustrative apparatus passage 180 has a diameter of about 0.890 inch and passage 184 has a diameter of about 0.122 inch. Passages 180 and 184 are in fluid communication as shown in FIG. 9. The end of body portion 184 is provided with a recess 190 to receive an end of tip adapter 160 and is in fluid communication with passage 184. The outer surface of the end of body portion 184 is provided with threads 194 for connection to tip retaining cap 162 in a manner which will be described.

Figure 11:
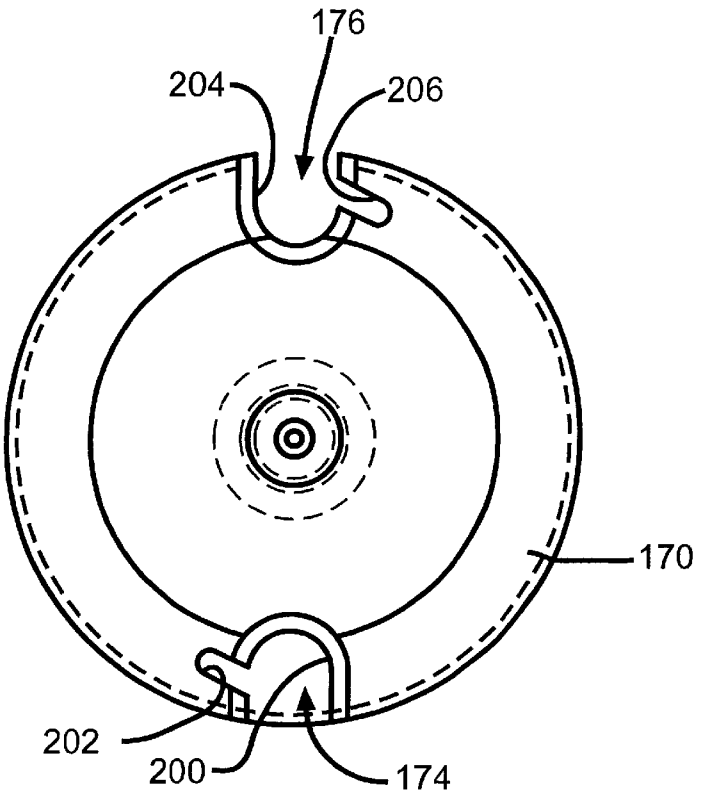
FIG. 11 is an elevational view of the opposite end of the assembly of FIG. 8.
Figure 10:
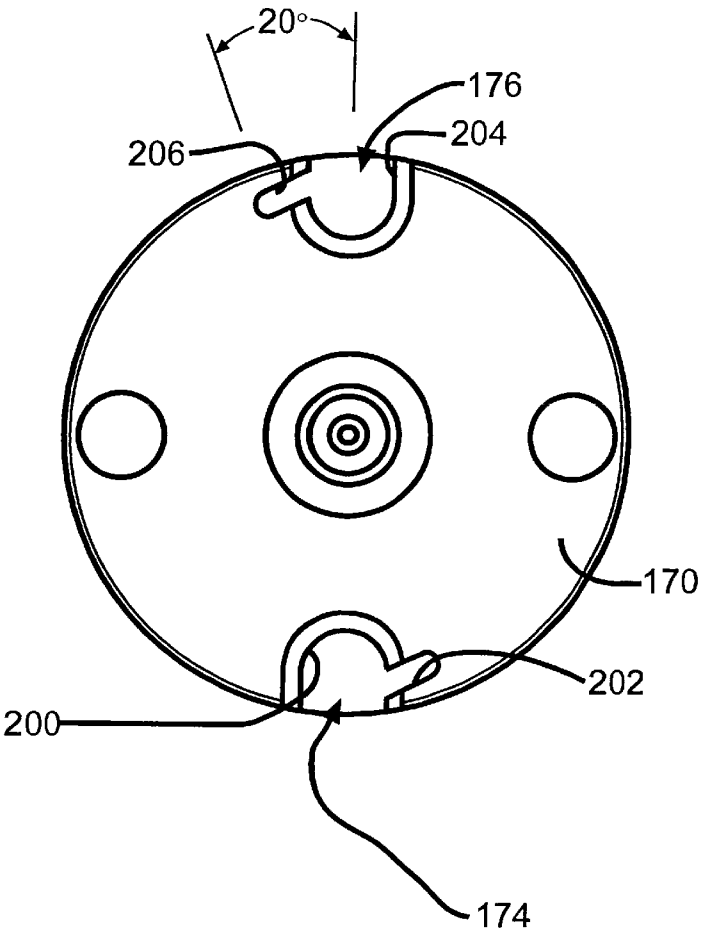
FIG. 10 is an elevational view of one end of the assembly of FIG. 8.

The formations 174 and 176 on body portion 170 are shown in further detail in FIGS. 10 and 11. Thus, formation 174 has a first portion 200 and a second smaller portion 202 extending therefrom, the second portion receiving the shank of a corresponding screw as previously described. Similarly, formation 176 has a first portion 204 and a second, smaller portion 206 extending therefrom, the second portion receiving the shank of a corresponding screw.

Figure 13:
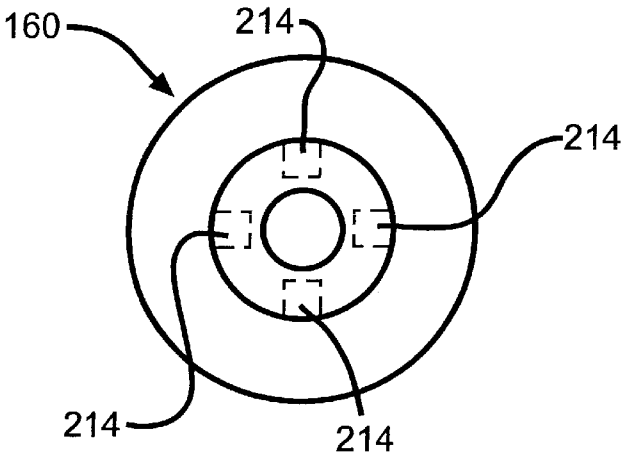
FIG. 13 is an elevational view of the left-hand end of the adapter of FIG. 12.
Figure 12:
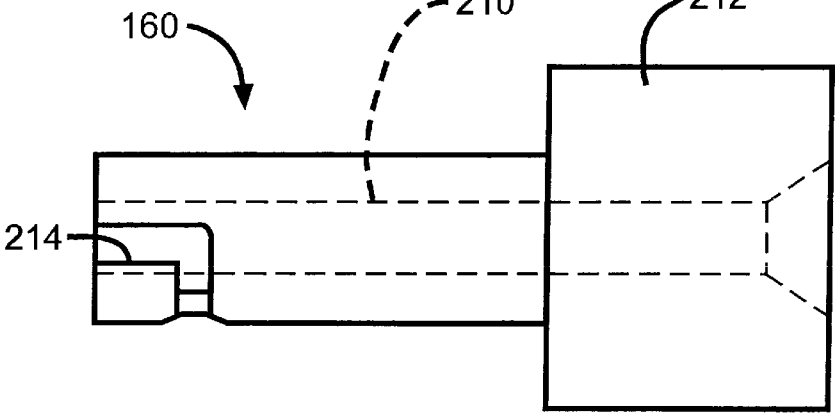
FIG. 12 is a side elevational view of the tip adapter of the apparatus of FIG. 3.

The tip adapter 160 is shown in further detail in FIGS. 12 and 13 and has a longitudinal passage 210. It also includes a relatively larger diameter body portion 212 which is received in recess 190 of body portion 184 of plunger cylinder assembly 154 as previously described. The opposite end of adapter 160 is provided with right-angle slot formations 214 to provide connection to a dispensing tip being cleaned. In particular, this arrangement is similar to that illustrated in FIG. 1 for connecting tip 10 to adapter 12, wherein the adapter is provided with internal pins to engage the right-angle slots in a bayonett-type connection. Other arrangements can of course be employed to connect adapter 160 to the dispensing tip being cleaned.

Figure 15:
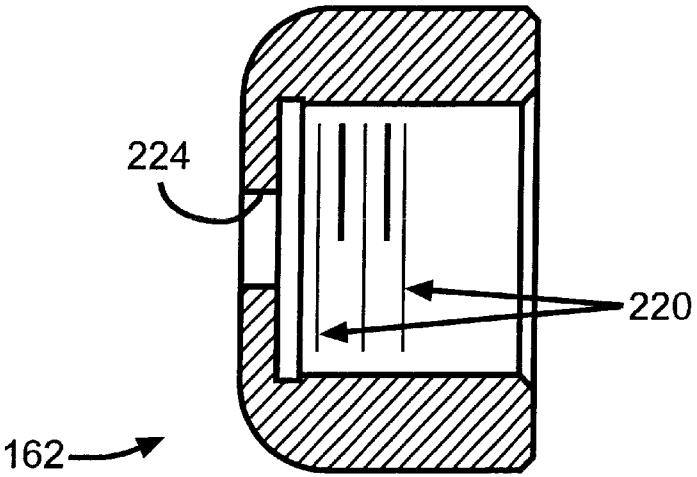
FIG. 15 is a longitudinal sectional view thereof.
Figure 14:
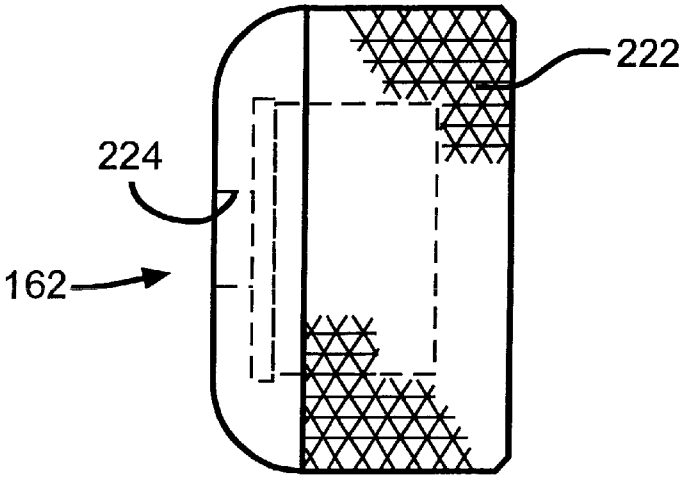
FIG. 14 is a side elevational view of the tip retaining cap of the apparatus of FIG. 3.

The tip retaining cap 162 is shown in further detail in FIGS. 14 and 15. It is provided with internal threads 220 for engaging threads 194 on the end of plunger assembly body portion 184. The knurled outer surface portion 222 facilitates manual connection of cap 162 on plunger assembly 154. When so connected, cap 152 serves to hold adapter 160 in place along with the dispensing tip carried thereby. A central opening 224 on the end of cap 162 accommodates a section of the body of the dispensing tip being cleaned.

Figure 16:
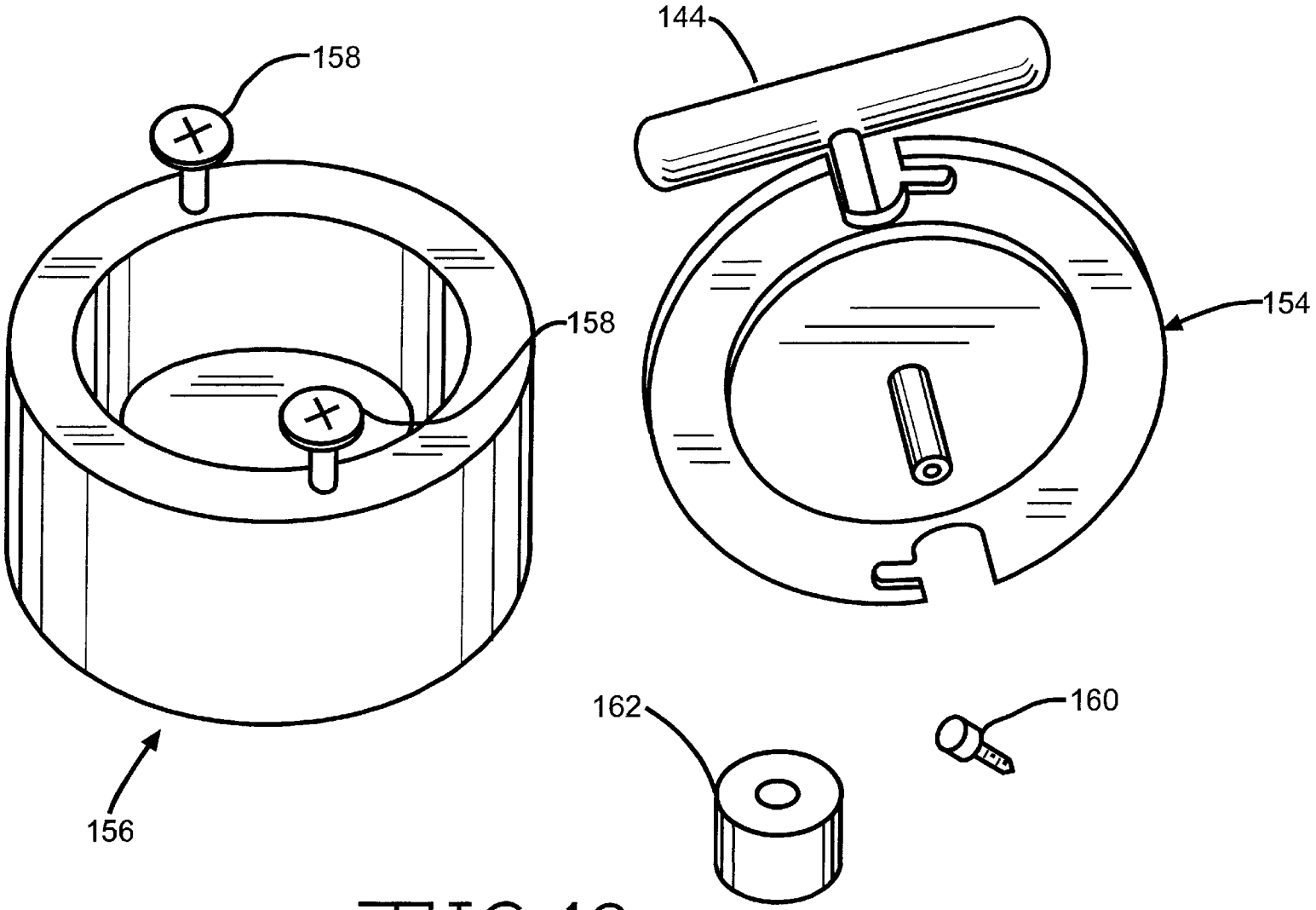
FIGS. 16—21 are perspective views further illustrating the apparatus of the present invention and its use.
Figure 17:
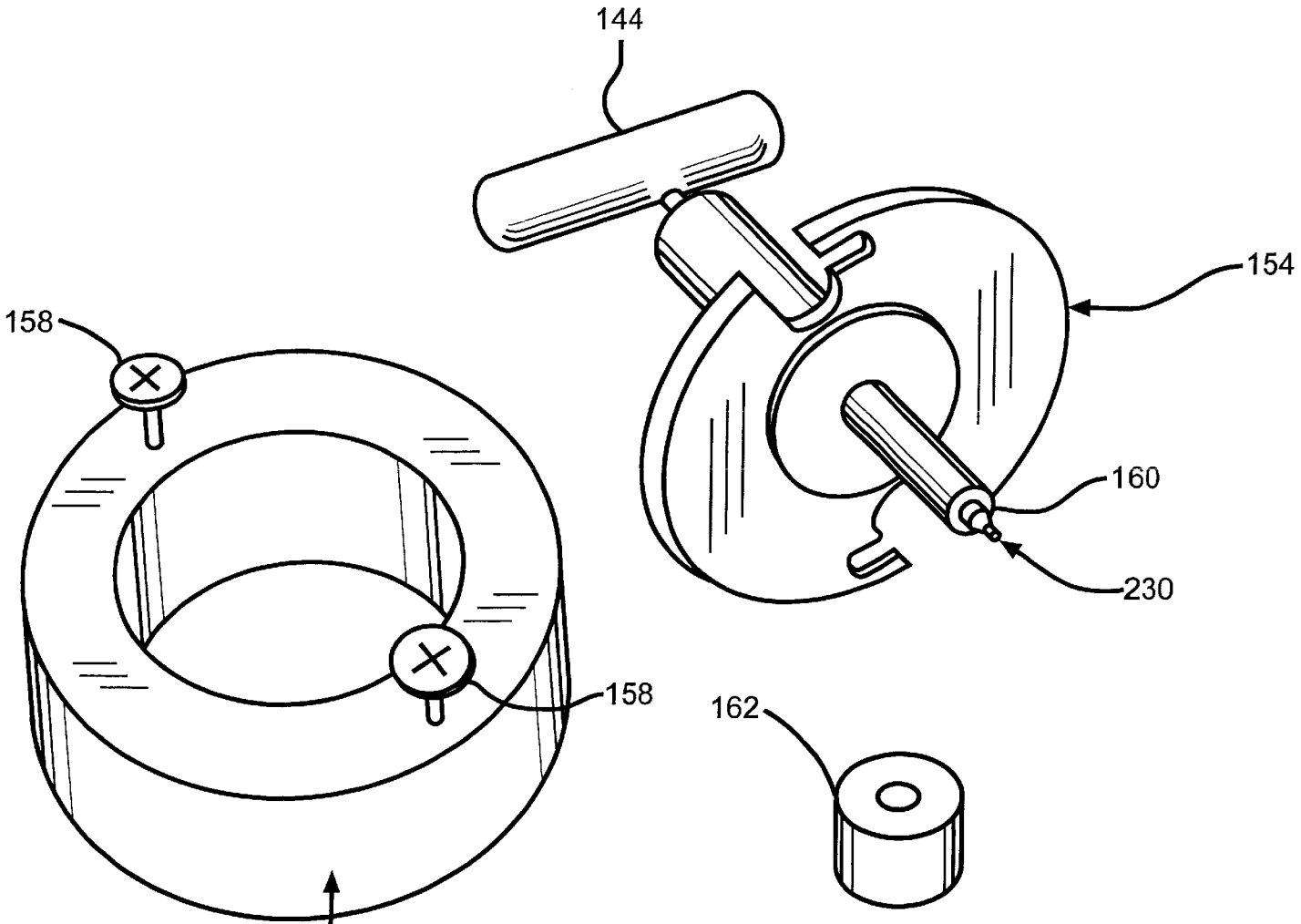
Figure 18:
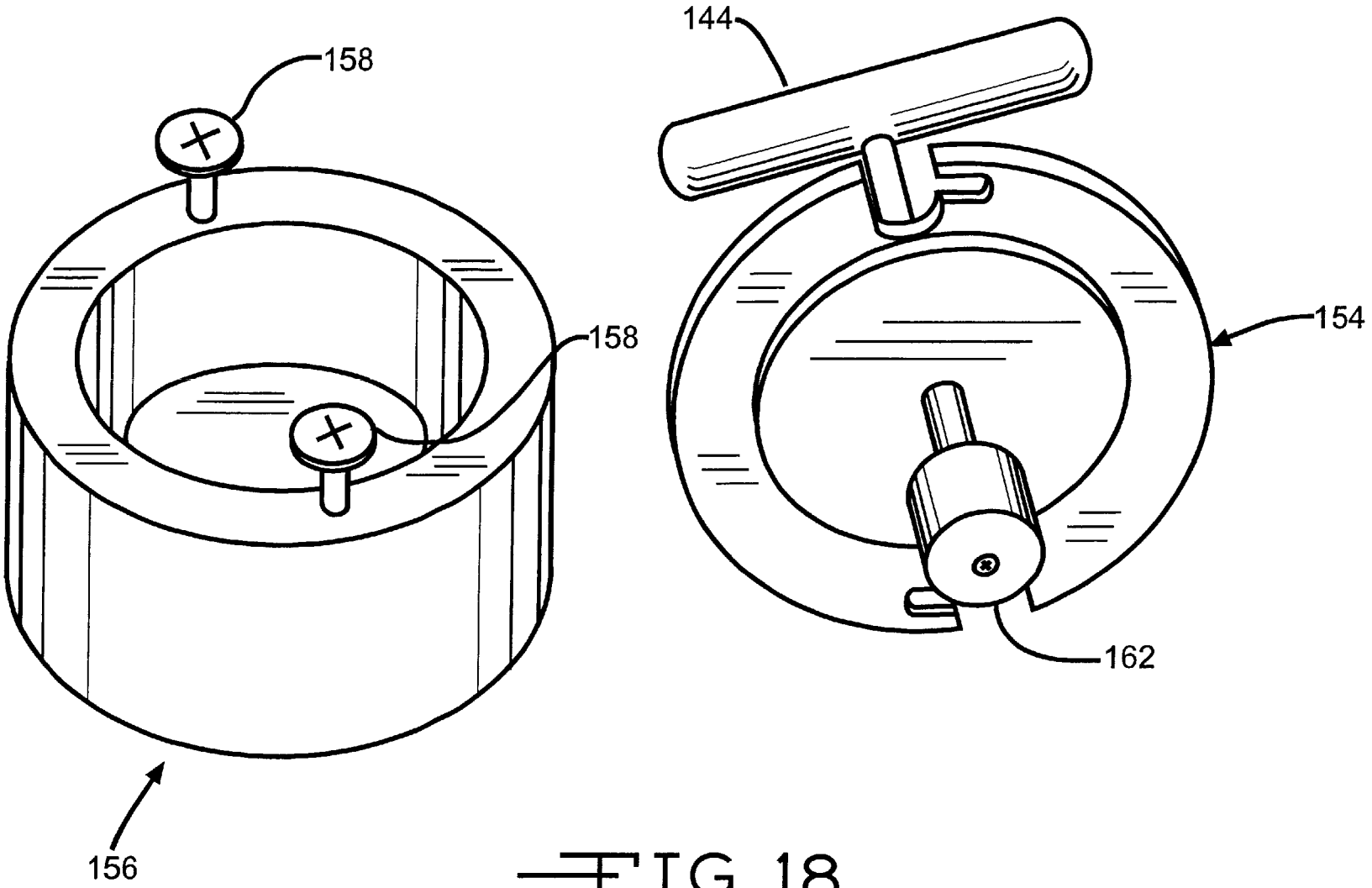
Figure 19:
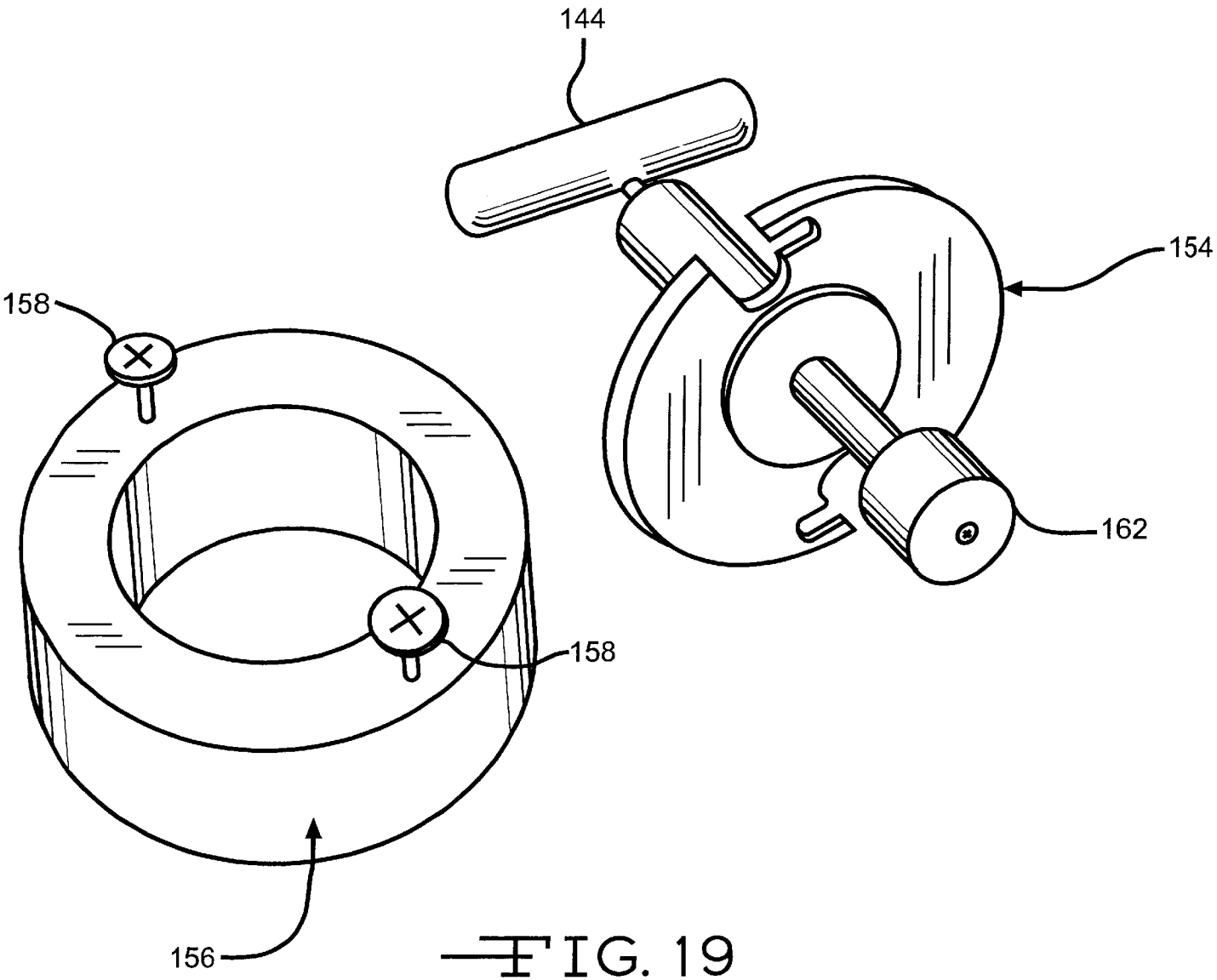

The apparatus of the present invention and the method of using the same are illustrated further in FIGS. 16–21. FIG. 16 is similar to FIG. 4 but shows tip adapter 160 and retaining cap 162 disconnected from the plunger cylinder assembly 154. FIG. 17 is similar to FIG. 16 but shows tip adapter 160 fitted into the end of the plunger cylinder assembly 154 and a dispensing tip 230 to be cleaned connected to the end of adapter 160. FIG. 18 shows retaining cap 162 being screwed by hand onto the end of plunger cylinder assembly 154 to retain adapter 160 and tip 230 in place. FIG. 19 shows the apparatus after completion of the operation illustrated in FIG. 18.

Figure 20:
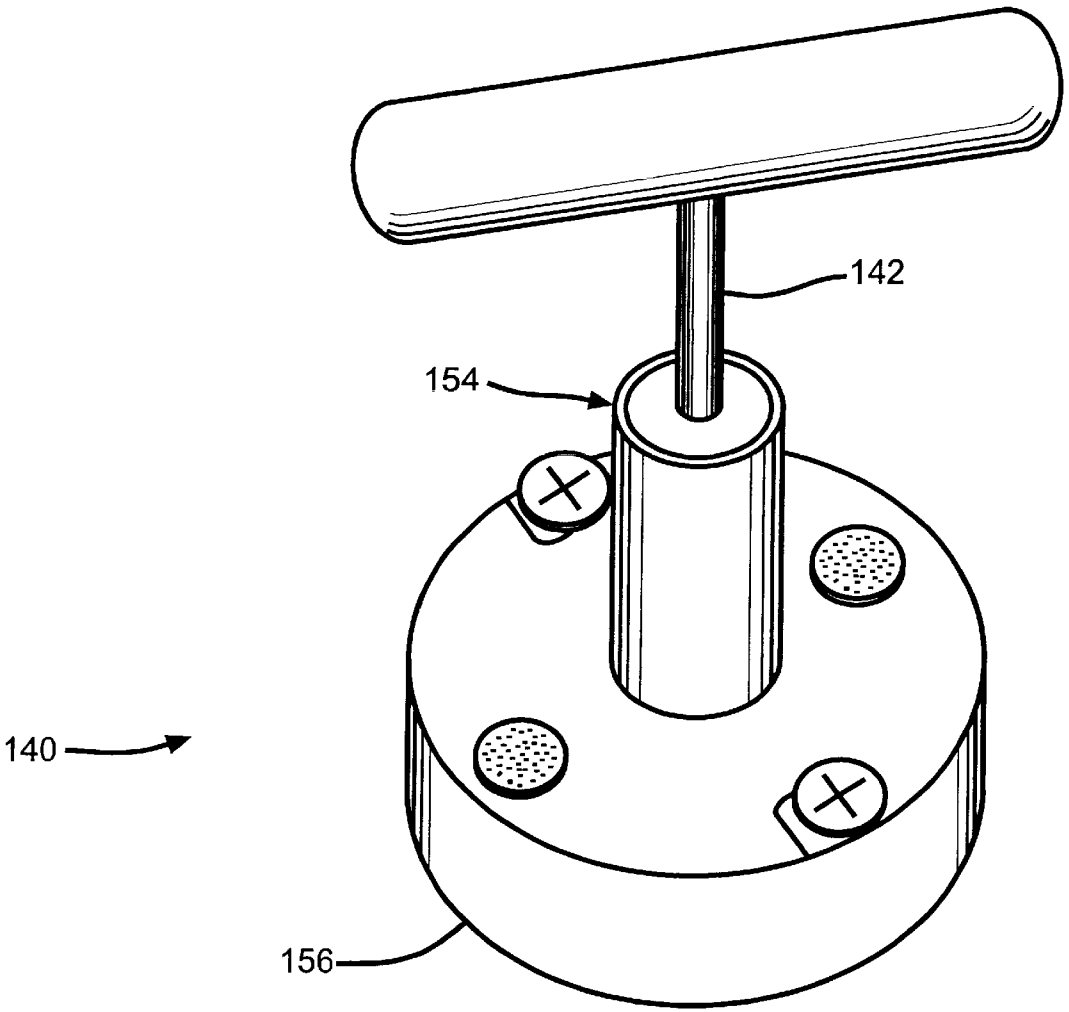
Figure 21:
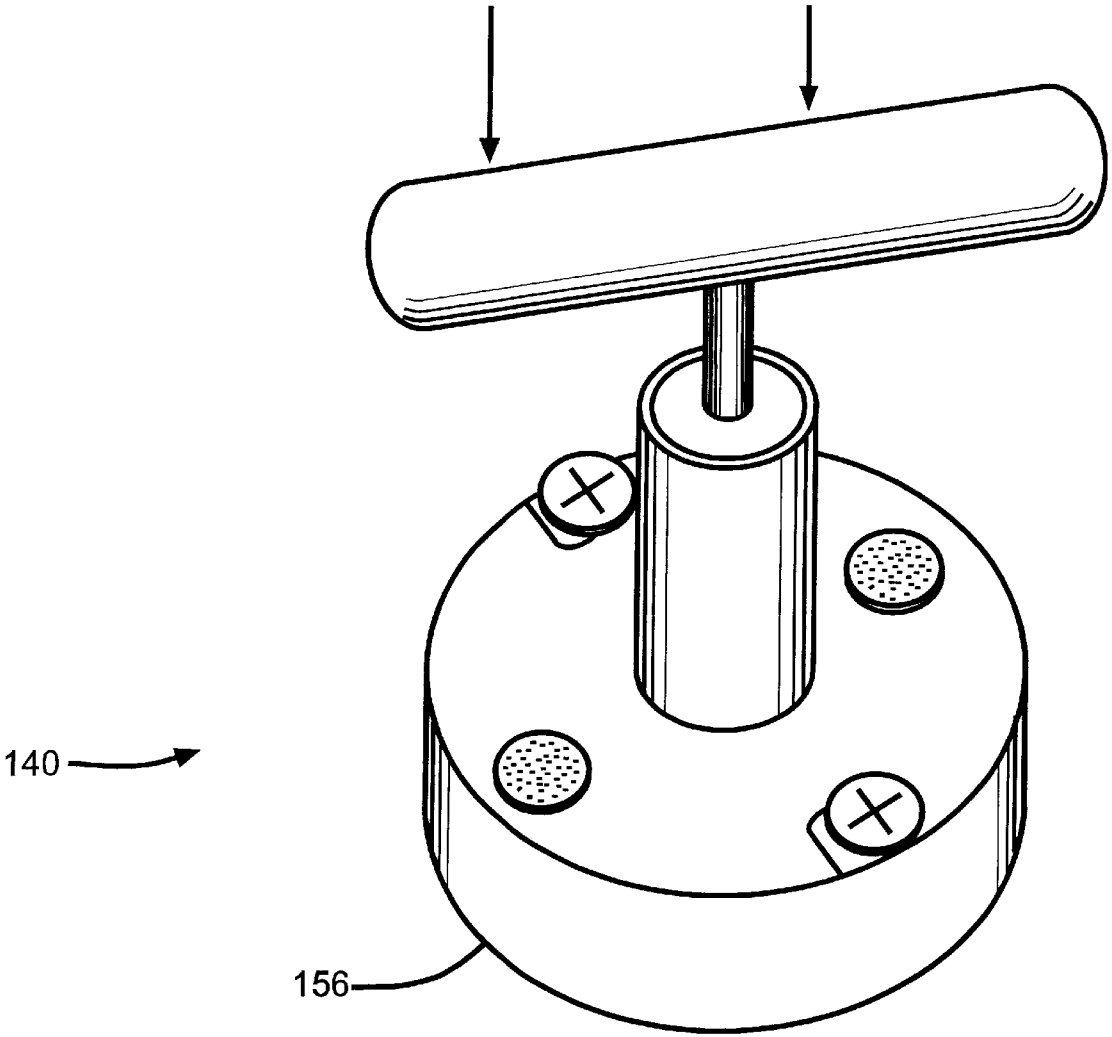

FIG. 20 shows plunger cylinder assembly 154 connected onto the bowl or container vessel 156 and the user of the apparatus grasping handle 144 to begin a downward thrust of the plunger. Prior to this step the combination of handle 144, shaft 142, cap 146 and tip 150 was withdrawn from the plunger cylinder assembly 154 and cleaning fluid introduced into the open end of the assembly 154. As the user pushes the plunger downwardly, the cleaning fluid is forced through assembly 154, through tip adapter 160 and through the internal passage of dispensing tip 230 to clean the same. The fluid exits from tip 230 into bowl 156. FIG. 21 shows the apparatus and the user at the end of the downward plunger stroke.

Dispensing tips to be cleaned are of metal, and typically the material to be cleaned, i.e. removed from, the internal surfaces of the tip is the adhesive previously described. The method and apparatus of the present invention can be used to clean other materials from such dispensing tips, and from tips made from materials other than metal. A wide variety of cleaning fluids can be used, examples being water and solvents such as methyl ethyl ketone to mention a few. In the arrangement described herein, the dispensing tip to be cleaned is connected to the adapter 160 by the pin and slot bayonett connection. Alternatively, the opening 224 in the end of retaining cap 162 can be employed to receive snugly a section of the dispensing tip body to hold the tip in place during the pressurized cleaning operation.

It is therefore apparent that the present invention accomplishes its intended objects. While an embodiment of the present invention has been described in detail, that has been done for the purpose of illustration, not limitation.

What is claimed is:

1. Apparatus for cleaning dispensing tips which are used with precision dispensing apparatus for delivering controlled amounts of fluid, said apparatus comprising:

a) a container;

b) a plunger assembly connected to said container and having an internal passage, a first end located in fluid communication with said container, and a second end spaced from said container;

c) said first end of said plunger assembly receiving and holding a dispensing tip so that the internal passage of said plunger assembly is in fluid communication with an internal passage of the tip; and d) an operator member on the second end of said plunger assembly for manual operation of a plunger of said assembly;

e) so that in response to manual operation of said plunger assembly cleaning fluid is forced from the internal passage of said plunger assembly through the internal passage of the tip to clean the internal passage of the tip whereupon the cleaning fluid exits the tip and is received by the container.

2. Apparatus according to claim 1, further including means for releasably connecting said plunger assembly to said container.

3. Apparatus according to claim 1, wherein a portion of said plunger assembly seals said container closed when said plunger assembly in connected to said container.

4. Apparatus according to claim 1 further including an adapter for coupling the dispensing tip to said plunger assembly.

5. Apparatus according to claim 4, wherein said adapter and the dispensing tip are provided with cooperating means for releasably connecting one to the other.

6. Apparatus according to claim 1 further including a retainer releasably connected to said first end of said plunger assembly for holding said adapter in place.

7. Apparatus according to claim 6, wherein said retainer is provided with means for holding the dispensing tip in place.

8. A method for cleaning dispensing tips which are used with precision dispensing apparatus for delivering controlled amounts of fluid, said method comprising:

a) providing a container;

b) supporting a tip to be cleaned within the container;

c) forcing cleaning fluid under high pressure to flow through an internal passage of the tip and then exit into the container so as to clean the internal passage of the tip; and d) sealing the container closed while cleaning fluid is forced through the tip.

9. A method according to claim 8 wherein forcing cleaning fluid through the tip is performed by a manually operated plunger assembly.

10. A method according to claim 8 wherein supporting the tip and forcing cleaning fluid through the tip is performed by a manually operated plunger assembly.

11. A method according to claim 9 including connecting the manually operated plunger assembly to seal the container closed.

12. A method according to claim 10 including connecting the manually operated plunger assembly to seal the container closed.

* * * * *

UNITED STATES PATENT AND TRADEMARK OFFICE

CERTIFICATE OF CORRECTION

PATENT NO. : 6,314,970 B1
DATED : November 13, 2001
INVENTOR(S) : Alan L. Everett It is certified that error appears in the above-identified patent and that said Letters Patent is hereby corrected as shown below:

Title page,
Item [54], the title "PRESSSURE" should be -- PRESSURE --.

Signed and Sealed this

Twenty-eighth Day of May, 2002

*Attest:*

*Attesting Officer*

JAMES E. ROGAN
*Director of the United States Patent and Trademark Office*